US011485545B2

(12) United States Patent
Okude et al.

(10) Patent No.: US 11,485,545 B2
(45) Date of Patent: Nov. 1, 2022

(54) REFILLABLE CONTAINER

(71) Applicant: NIPPON PAPER INDUSTRIES CO., LTD., Tokyo (JP)

(72) Inventors: Hideki Okude, Tokyo (JP); Takaharu Noda, Tokyo (JP)

(73) Assignee: NIPPON PAPERS INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/268,707

(22) PCT Filed: Jun. 28, 2019

(86) PCT No.: PCT/JP2019/025983

§ 371 (c)(1),
(2) Date: Feb. 16, 2021

(87) PCT Pub. No.: WO2020/039749

PCT Pub. Date: Feb. 27, 2020

(65) Prior Publication Data

US 2021/0171242 A1 Jun. 10, 2021

(30) Foreign Application Priority Data

Aug. 21, 2018 (JP) ..... JP2018-154468

(51) Int. Cl.

| | |
|---|---|
| ***B65D 25/24*** | (2006.01) |
| ***B65D 25/34*** | (2006.01) |
| ***B65D 77/06*** | (2006.01) |

(52) U.S. Cl.

CPC ..... *B65D 25/24* (2013.01); *B65D 25/34* (2013.01); *B65D 77/06* (2013.01)

(58) Field of Classification Search

CPC ..... B65D 25/24; B65D 25/34; B65D 77/06; B65D 77/0466; B65D 77/0473; B65D 77/0486; B05B 11/0054; B05B 11/0064

See application file for complete search history.

(56) References Cited

U.S. PATENT DOCUMENTS

2005/0218159 A1* 10/2005 Hoour ..... B65D 77/0486 222/321.7

* cited by examiner

*Primary Examiner* — Andrew T Kirsch

(74) *Attorney, Agent, or Firm* — Wenderoth, Lind & Ponack, L.L.P.

(57) ABSTRACT

A refillable container that includes: an inner container; a support member configured to support the inner container; and a cover having a tubular shape, which is fitted, from above the inner container, to an outer periphery of the inner container supported on the support member so as to accommodate the inner container therein, and is fitted to the support member. The support member includes: a support base portion including a tubular leg portion and having a raised bottom; and a support frame portion, which is provided on an upper surface of a bottom plate of the support base portion, and is configured to support the bottom of the inner container. The support base portion includes a seat step portion on which an opening end of the cover fitted to the support member is seated. The cover is made of hard plastic, and the support member is made of soft plastic.

4 Claims, 5 Drawing Sheets

REFILLABLE CONTAINER

BACKGROUND OF THE INVENTION

1. Technical Field

The present invention relates to a refillable container capable of being refilled with a liquid content such as cosmetics or a detergent.

2. Description of the Related Art

Hitherto, as a refillable container capable of being refilled with a liquid content such as cosmetics or a detergent, the applicant of the present invention has proposed a refillable container including: an inner container, which is configured to store a content therein, and is to be replaced when the content is used up; a support member configured to support the inner container in an upright posture by holding a bottom of the inner container; and a cover having a tubular shape, which is fitted, from above the inner container, to an outer periphery of the inner container supported on the support member so as to accommodate the inner container therein, and is fitted to the support member at a distal end portion of the cover (see, for example, JP 2018-52611 A).

In the refillable container as described in JP 2018-52611, when the content is used up, the support member is removed from the cover, and fingers are inserted through an opening portion of the cover so as to hold the bottom of the inner container remaining in the cover. The inner container is pulled out of the cover, and then a new inner container is supported on the support member. The cover is fitted, from above the inner container, to the outer periphery of the inner container supported on the support member so as to accommodate the inner container therein, and the distal end portion of the cover is fitted to the support member. In this manner, the inner container is replaced.

SUMMARY OF THE INVENTION

1. Technical Problem

In the refillable container as described in JP 2018-52611, fitting portions of the cover and the support member are brought into press contact with each other. A frictional force between the fitting portions in press contact is large enough to bear the weight of the inner container in order to prevent the support member from easily slipping out of the cover due to the weight of the inner container supported on the support member.

The support member is removed from the cover by pulling and taking the support member out of the cover with a strong force. However, it is required that the pulling force be larger than the frictional force between the cover and the support member.

In general, each of the support member and the cover is made of hard plastic, and has a small elastic modulus. Accordingly, when the support member is pulled with a strong force, the cover and the support member are hardly deformed, and a press contact state between the cover and the support member is hardly changed. Therefore, a strong force is required to pull the support member out of the cover.

However, when the support member is pulled out of the cover, a support base portion of the support member exposed from the cover is pinched and held from both sides of the support member. In this manner, the support member is pulled out of the cover. Thus, the frictional force between the fitting portions of the support member and the cover is large. In addition, a range of holding the support base portion is narrow, and the support base portion easily slips out of a user's hand. Accordingly, it is difficult to apply a strong pulling force to the support member. Therefore, there is a problem in that the support member cannot be smoothly removed from the cover, which causes an operation for replacement of the inner container to be troublesome.

Further, each of the support member and the cover is made of hard plastic. Therefore, there is a problem in that, when the refillable container is dropped at the time of, for example, replacement of the inner container, the refillable container can be damaged by a shock in some cases.

It is an object of the present invention to provide a refillable container capable of preventing a support member fitted to a cover from easily slipping out of the cover under normal usage, capable of easily removing the support member from the cover at the time of refilling of the inner container, and capable of preventing damage caused by a shock.

2. Solution to the Problem

In order to achieve the object described above, the present invention provides a refillable container, including: an inner container, which is configured to store a content therein, and is to be replaced when the content is used up; a support member configured to support the inner container in an upright posture by holding a bottom of the inner container; and a cover having a tubular shape, which is fitted, from above the inner container, to an outer periphery of the inner container supported on the support member so as to accommodate the inner container therein, and is fitted to the support member, the support member including: a support base portion including a tubular leg portion and having a raised bottom; and a support frame portion, which is provided on an upper surface of a bottom plate of the support base portion, and is configured to support the bottom of the inner container, the support base portion including a seat step portion on which an opening end of the cover fitted to the support member is seated. The cover is made of hard plastic, and the support member is made of soft plastic.

According to the present invention, the support member is made of the soft plastic. With this configuration, when the support base portion of the support member exposed from the cover is pressed inward from both sides of the support member, the support base portion is easily deformed so as to bend downward with respect to an axis substantially orthogonal to an axis of the pressing direction. As a result, a gap is defined in a part of a contact surface region between fitting portions of the support member and the cover, thereby reducing a contact area and reducing a frictional force. Therefore, even when the fitting portions of the support member and the cover are fitted to each other in a large contact surface region with a large frictional force, the support base portion is pressed and deformed when the support member is removed from the cover, thereby being capable of easily removing the support member from the cover.

Moreover, when the refillable container is dropped at the time of, for example, replacement of the inner container, the support member made of the soft plastic absorbs the shock, thereby being capable of preventing damage of the refillable container.

According to a second aspect of the invention, the support member includes a seat projecting portion formed on a portion of an outer periphery of the tubular leg portion of the support base portion exposed from the cover fitted to the support member.

According to the second aspect of the invention, the seat projecting portion is formed on the portion of the outer periphery of the tubular leg portion of the support base portion exposed from the cover fitted to the support member. With this configuration, when the support base portion exposed from the cover is pressed in order to remove the support member fitted to the cover, fingers are put on the seat projecting portion. In this case, there is no fear in that the fingers pressing the support base portion slip off a surface of the support base portion. Therefore, a pressing force can be reliably transmitted, and the support base portion can be easily deformed.

According to a third aspect of the invention, the seat projecting portion formed on the outer periphery of the tubular leg portion of the support base portion is formed at each of positions opposed to each other across substantially a center of the tubular leg portion.

According to the third aspect of the invention, the seat projecting portion formed on the outer periphery of the tubular leg portion of the support base portion is formed at each of positions opposed to each other across substantially a center of the tubular leg portion. With this configuration, when the support base portion is pressed, fingers are put on the seat projecting portions formed at the positions opposed to each other across substantially the center of the tubular leg portion, thereby being capable of easily pressing and deforming the support base portion inward from both sides of the support base portion.

According to a fourth aspect of the invention, the cover includes a cutout portion formed in a portion of an opening end of a tubular wall portion of the cover.

According to the fourth aspect of the invention, the cover includes the cutout portion formed in the portion of the opening end of the tubular wall portion. With this configuration, when the cover is fitted to the support member and the opening end of the tubular wall portion is seated on the seat step portion formed on the support base portion of the support member, the seat step portion is partially exposed through the cutout portion. With this configuration, when the support base portion is pressed, fingers are put on the seat step portion exposed through the cutout portion. In this case, there is no fear in that the fingers pressing the support base portion slip off a surface of the support base portion. Therefore, a pressing force can be reliably transmitted, and the support base portion can be easily deformed.

3. Advantageous Effects of the Invention

According to the refillable container of the present invention, even when the fitting portions of the support member and the cover are fitted to each other with a large frictional force, the support member can be easily removed from the cover by pressing and deforming the support base portion. Thus, the support member fitted to the cover does not easily slip out of the cover under normal usage, and the support member can be easily removed from the cover at the time of refilling of the inner container.

Moreover, when the refillable container is dropped at the time of, for example, replacement of the inner container, the support member made of the soft plastic absorbs the shock, thereby being capable of preventing damage of the refillable container.

DETAILED DESCRIPTION OF EMBODIMENTS OF THE INVENTION

Now, an example of a refillable container according to one embodiment of the present invention is described in detail with reference to the drawings.

Figure 1:
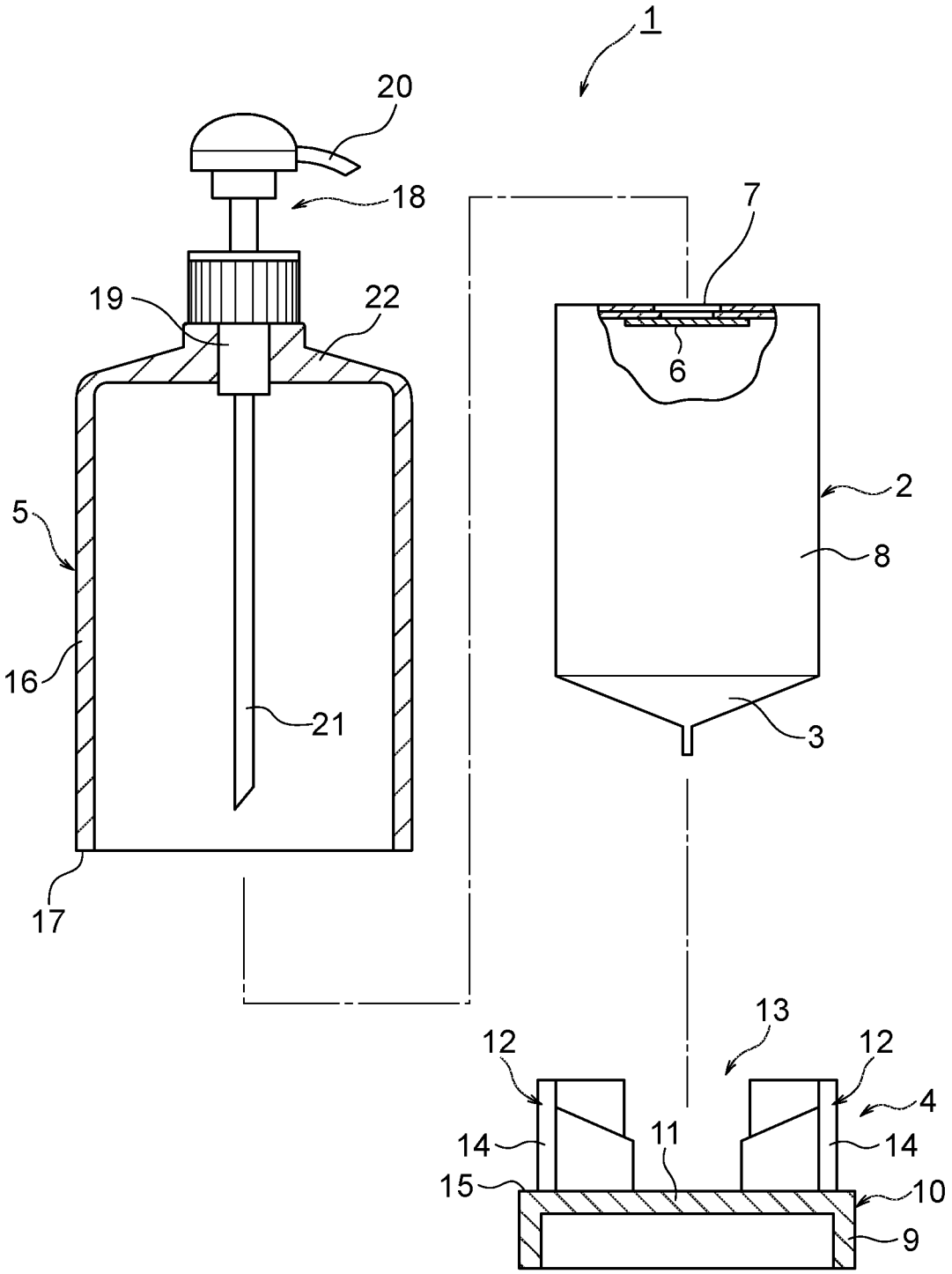
FIG. 1 is an exploded sectional view for illustrating an example of a refillable container according to one embodiment of the present invention.
Figure 2:
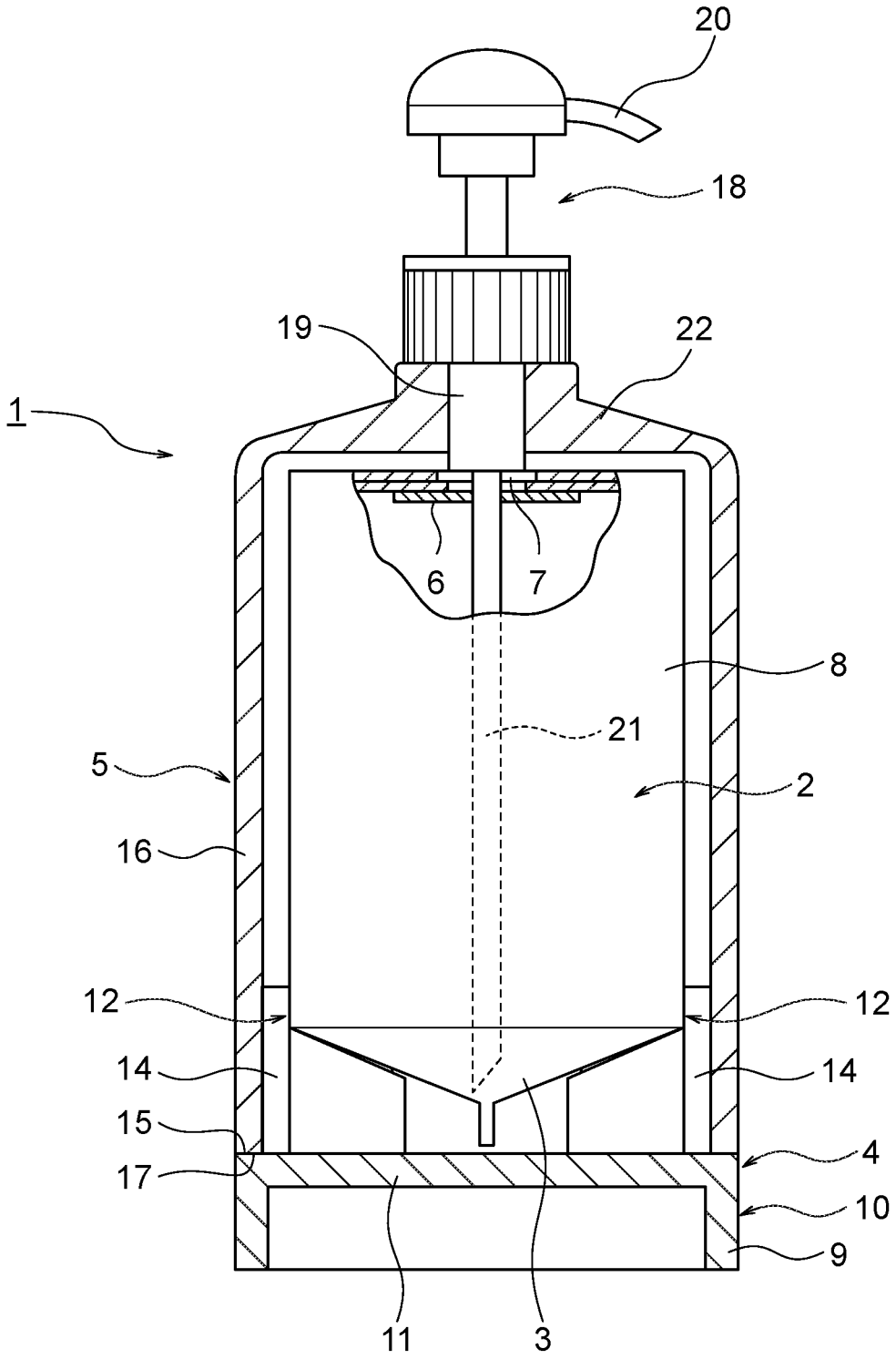
FIG. 2 is a sectional view for illustrating a state in which a cover is fitted to a support member that supports an inner container of the refillable container illustrated in FIG. 1.
Figure 3:
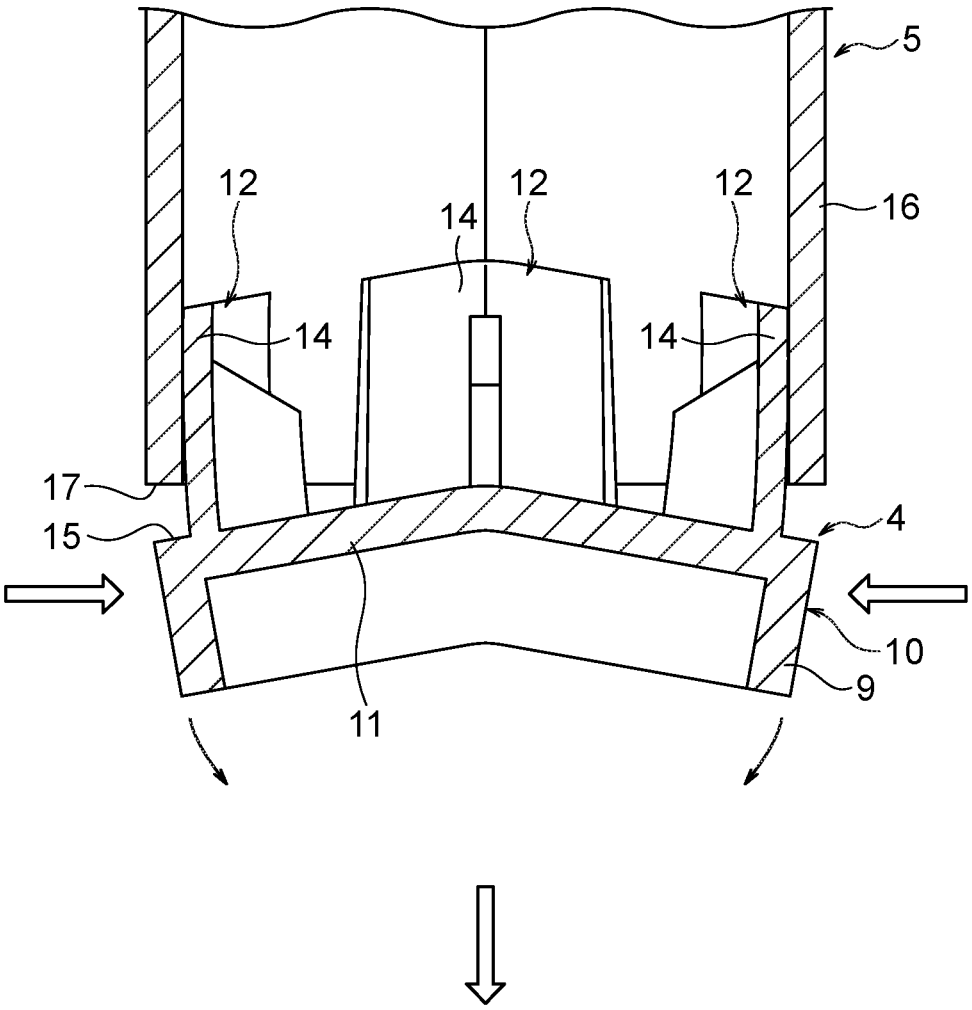
FIG. 3 is an explanatory view for illustrating a state in which the support member is removed from the cover.
Figure 4:
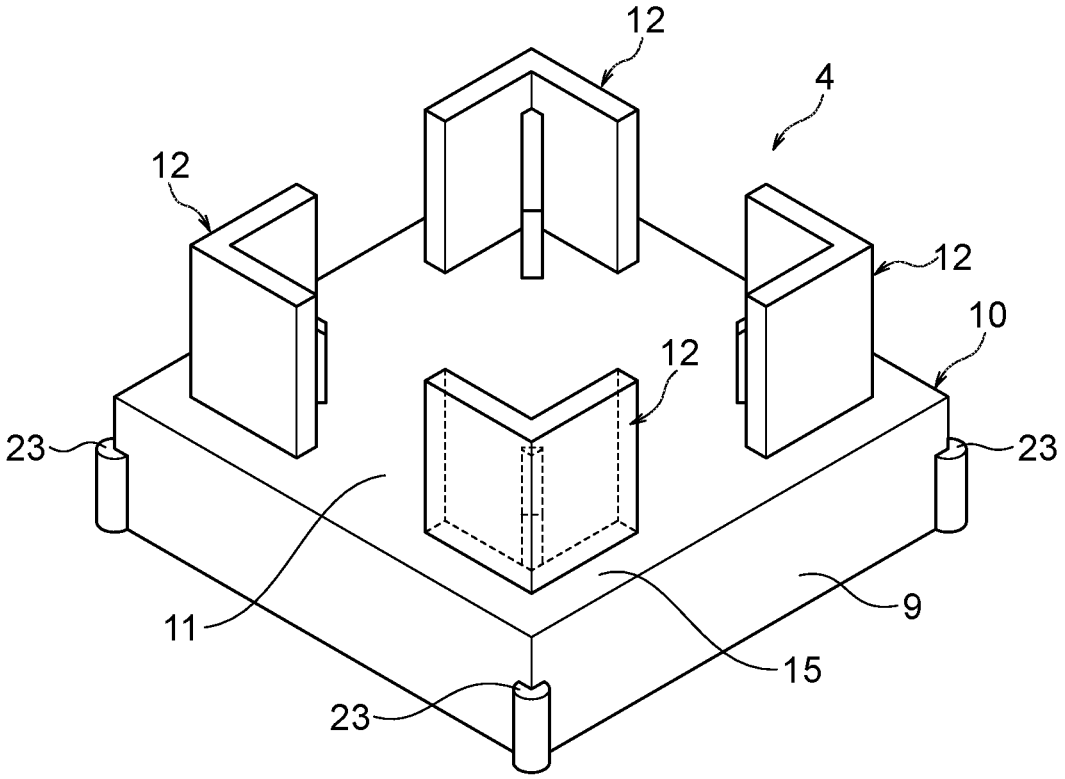
FIG. 4 is a perspective view for illustrating another example of the support member illustrated in FIG. 1.
Figure 5:
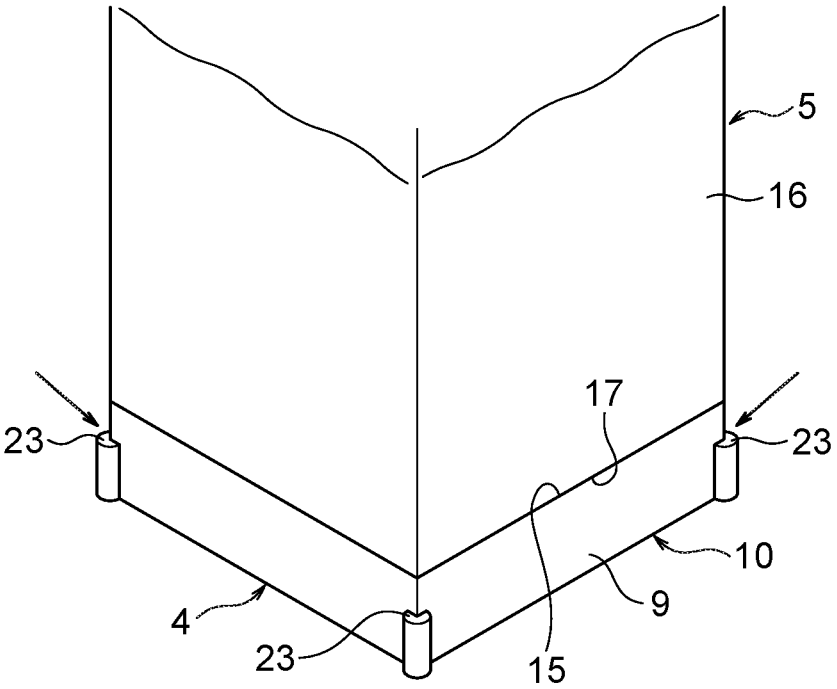
FIG. 5 is an explanatory view for illustrating a way of removing the support member illustrated in FIG. 4 from the cover.
Figure 6:
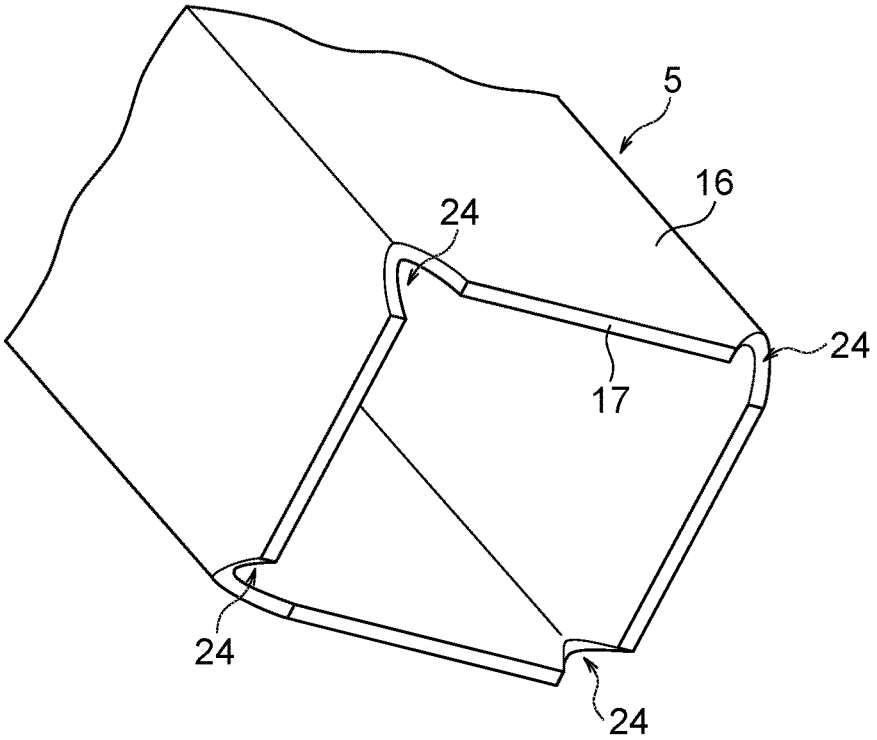
FIG. 6 is a partial perspective view for illustrating another example of the cover illustrated in FIG. 1.
Figure 7:
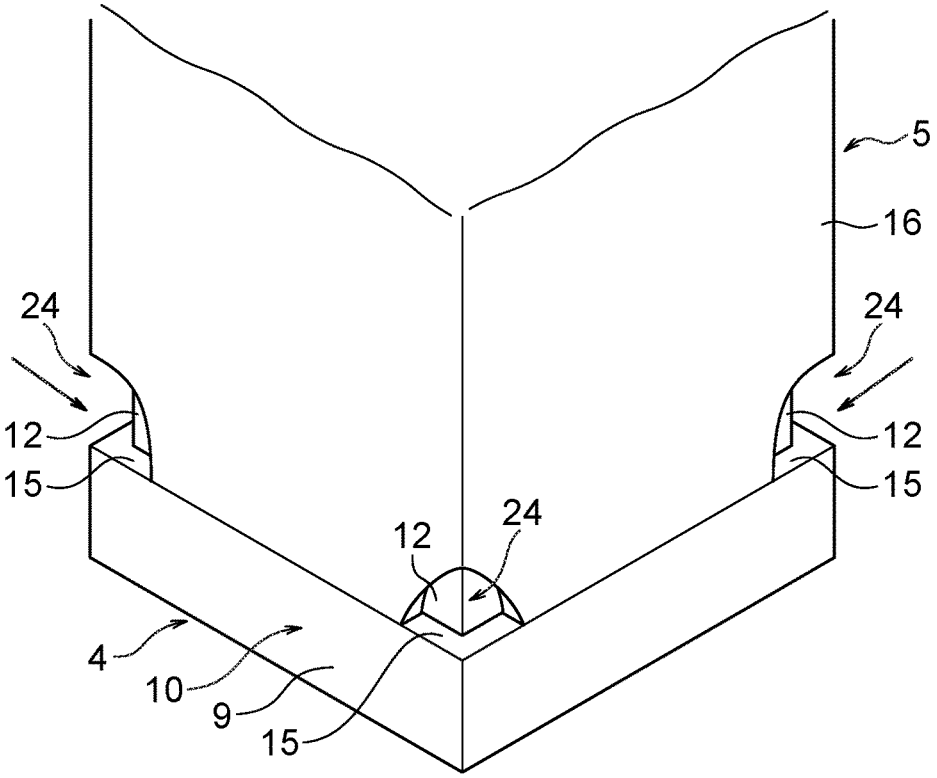
FIG. 7 is an explanatory view for illustrating a way of removing the support member from the cover illustrated in FIG. 6.

FIG. 1 to FIG. 7 are illustrations of an example of the refillable container according to one embodiment of the present invention. FIG. 1 is an exploded sectional view for illustrating the refillable container according to one embodiment of the present invention. FIG. 2 is a sectional view for illustrating a state in which a cover is fitted to a support member that supports an inner container of the refillable container illustrated in FIG. 1. FIG. 3 is an explanatory view for illustrating a state in which the support member is removed from the cover. FIG. 4 is a perspective view for illustrating another example of the support member illustrated in FIG. 1. FIG. 5 is an explanatory view for illustrating a way of removing the support member illustrated in FIG. 4 from the cover. FIG. 6 is a partial perspective view for illustrating another example of the cover illustrated in FIG. 1. FIG. 7 is an explanatory view for illustrating a way of removing the support member from the cover illustrated in FIG. 6.

A refillable container 1 in this embodiment includes an inner container 2, a support member 4, and a cover 5. The inner container 2 is configured to store a content therein, and is to be replaced when the content is used up. The support member 4 is configured to support the inner container 2 by holding a bottom 3 of the inner container 2. The cover 5 has a tubular shape. The cover 5 is fitted, from above the inner container 2, to an outer periphery of the inner container 2 supported on the support member 4 so as to accommodate the inner container 2 therein, and is fitted to the support member 4.

The inner container 2 has a suction port 7 formed in an upper surface portion thereof and sealed with a tearable sealing sheet 6. A body 8 of the inner container 2 has a quadrangular sectional shape. Further, the bottom 3 has such a pyramidal shape that its center is deepest.

The inner container 2 in this embodiment has a quadrangular sectional shape, but may have a sectional shape other than the quadrangular shape, such as a polygonal shape, a circular shape, or an elliptical shape.

The support member 4 includes a support base portion 10 and a support frame portion 12. The support base portion 10 includes a tubular leg portion 9, and has a raised bottom. The support frame portion 12 is formed on an upper surface of a bottom plate 11 of the support base portion 10, and is configured to support the bottom 3 of the inner container 2 in an upright posture.

The support frame portion 12 is shaped such that its upper portion forms a receiving opening 13 configured to receive the bottom 3 of the inner container 2 so as to receive the bottom 3 of the inner container 2 within the support frame portion 12. The support frame portion 12 is formed into a shape conforming to a contour of the body 8 of the inner container 2. In this embodiment, the support frame portion 12 has a quadrangular shape in conformity to the shape of the body 8 of the inner container 2.

Further, the support frame portion 12 in this embodiment includes support frame pieces 14 configured to support an outer surface of the inner container 2. The support frame pieces 14 are formed on the upper surface of the bottom plate 11 of the support base portion 10 at intervals therebetween so as to extend upright along four corner portions of the body 8 of the inner container 2.

In this embodiment, the support frame portion 12 includes four support frame pieces 14, but may be a tubular member capable of receiving the bottom 3 of the inner container 2. The shape of the support frame portion 12 is not particularly limited as long as the support frame portion 12 can support the bottom 3 of the inner container 2 so as to support the inner container 2 in an upright posture.

Further, the support base portion 10 includes a seat step portion 15 on which an opening end of the cover 5, which is described later and fitted to the support base portion 10, is seated. In this embodiment, the bottom plate 11 of the support base portion 10 is formed to have a diameter larger than that of the support frame portion 12, and a surface of the bottom plate 11 located outside the support frame portion 12 serves as the seat step portion 15.

In the present invention, the support member 4 configured as described above is made of soft plastic. As the soft plastic, polyethylene (PE) is used, but a material to be used as the soft plastic is not particularly limited as long as the material satisfies the effects of the present invention.

With regard to the cover 5, the cover 5 in this embodiment includes a tubular wall portion 16 fitted, from above the inner container 2, to the outer periphery of the inner container 2 supported on the support member 4 so as to accommodate the inner container 2 therein.

In this embodiment, the tubular wall portion 16 is fitted to the outer periphery of the inner container 2 supported on the support member 4, and is fitted to an outer periphery of the support frame portion 12 on the support base portion 10 of the support member 4. An opening end 17 of the tubular wall portion 16 is seated on the seat step portion 15 formed on the bottom plate 11 of the support base portion 10.

In the present invention, the cover 5 configured as described above is made of hard plastic. As the hard plastic, polypropylene (PP) is used, but a material to be used as the hard plastic is not particularly limited as long as the material satisfies the effects of the present invention.

In this embodiment, the cover 5 includes a dispense pump 18 configured to pump up the content in the inner container 2 supported on the support member 4 and dispense the content to an outside of the refillable container. The dispense pump 18 includes a tubular cylinder portion 19, a dispense nozzle 20, and a suction tube 21. The dispense nozzle 20 is provided at an upper part of the tubular cylinder portion 19, and serves also as an operation portion for a piston that is slidably fitted into the tubular cylinder portion 19. The suction tube 21 is provided at a lower part of the tubular cylinder portion 19. The tubular cylinder portion 19 penetrates a top plate portion 22 of the cover 5, and is fixed to the top plate portion 22. The dispense nozzle 20 is arranged on an upper surface side of the top plate portion 22, and the suction tube 21 is arranged on a lower surface side of the top plate portion 22.

When the tubular wall portion 16 of the cover 5 is fitted to the outer periphery of the support frame portion 12 formed on the support base portion 10 of the support member 4, the suction tube 21 arranged on the lower surface side of the top plate portion 22 of the cover 5 tears the sealing sheet 6 provided on the upper surface portion of the inner container 2, and thus is inserted into the inner container 2 through the suction port 7.

According to the refillable container 1 configured as described above, the support member 4 is made of the soft plastic. With this configuration, in a case in which the support member 4 fitted to the cover 5 is removed from the cover 5 in order to replace the inner container 2, when the support base portion 10 of the support member 4 exposed to the outside from the opening end 17 of the tubular wall portion 16 of the cover 5 is pinched from both sides of the support member 4, and then is pressed so as to be slightly squeezed inward, as illustrated in FIG. 3, the support base portion 10 is easily deformed so as to bend downward with respect to an axis substantially orthogonal to an axis of the pressing direction. As a result, a gap is defined in a part of a contact surface region between fitting portions of the support member 4 and the cover 5.

In this embodiment, the support frame portion 12 has a quadrangular shape. With this configuration, in a case in which the tubular leg portion 9 of the support base portion 10 of the support member 4 is pressed inward, when two opposing corner portions of four corner portions of the tubular leg portion 9 are pressed, fingers are suitably put on the corner portions, thereby being capable of easily pressing the tubular leg portion 9.

With this configuration, a contact area between the fitting portions of the support member 4 and the cover 5 is reduced, and thus a frictional force is reduced. Accordingly, the support member 4 can be easily removed from the cover 5.

Moreover, when the refillable container 1 is dropped at the time of, for example, replacement of the inner container 2, the support member 4 made of the soft plastic absorbs the shock, thereby being capable of preventing damage of the refillable container 1.

FIG. 4 is an illustration of another example of the support member 4 illustrated in FIG. 1. The support member 4 in this embodiment includes seat projecting portions 23 formed on portions of the outer periphery of the tubular leg portion 9 of the support base portion 10 exposed from the cover 5 fitted to the support member 4.

In this embodiment, the support frame portion 12 has a quadrangular shape, and it is preferred that the seat projecting portions 23 be formed on at least two opposing corner portions of the four corner portions of the tubular leg portion 9 of the support base portion 10. In this embodiment, the seat projecting portions 23 are formed on the four corner portions of the tubular leg portion 9, respectively.

In the support member 4 configured as described above, in a case in which two opposing corner portions of the tubular leg portion 9 are pinched, when fingers are put on the seat projecting portions 23 from directions indicated by the arrows of FIG. 5, there is no fear in that the fingers pressing the support base portion 10 slip off a surface of the support base portion 10. Therefore, a pressing force can be reliably transmitted, and the support base portion 10 can be more easily deformed.

FIG. 6 is an illustration of another example of the cover 5 illustrated in FIG. 1. The cover 5 in this embodiment includes cutout portions 24 formed in portions of the opening end 17 of the tubular wall portion 16.

In this embodiment, the support frame portion 12 has a quadrangular shape, and it is preferred that the cutout portions 24 be formed in at least two opposing corner portions of four corner portions of the tubular wall portion 16. In this embodiment, the cutout portions 24 are formed in the four corner portions of the tubular wall portion 16, respectively.

In the cover 5 configured as described above, the cutout portions 24 are formed in the portions of the opening end 17 of the tubular wall portion 16. With this configuration, when the cover 5 is fitted to the support member 4, and the opening end 17 of the tubular wall portion 16 is seated on the seat step portion 15 formed on the support base portion 10 of the support member 4, the seat step portion 15 is partially exposed through the cutout portions 24. Accordingly, in a case in which two opposing corner portions of the tubular leg portion 16 are pinched, when fingers are put on the seat step portion 15 exposed through the cutout portions 24 from directions indicated by the arrows of FIG. 7, there is no fear in that the fingers pressing the support base portion 10 slip off the surface of the support base portion. Therefore, a pressing force for squeezing can be reliably transmitted, and the support base portion 10 can be more easily deformed.

REFERENCE SIGNS LIST

1 refillable container
2 inner container
3 bottom
4 support member
5 cover
6 sealing sheet
7 suction port
8 body
9 tubular leg portion
10 support base portion
11 bottom plate
12 support frame portion
13 receiving opening
14 support frame piece
15 seat step portion
16 tubular wall portion
17 opening end
18 dispense pump
19 tubular cylinder portion
20 dispense nozzle
21 suction tube
22 top plate portion
23 seat projecting portion
24 cutout portion

The invention claimed is:

1. A refillable container, comprising:

an inner container, which is configured to store a content therein, wherein the inner container can be replaced when the content is used up;

a support member configured to support the inner container in an upright posture by holding a bottom of the inner container; and a cover having a tubular shape, which is fitted, from above the inner container, to an outer periphery of the inner container supported on the support member so as to accommodate the inner container therein, and is fitted to the support member, the support member including:

a support base portion including a bottom plate portion and a tubular leg portion projecting from the bottom plate portion to define a raised bottom; and a support frame portion, which is provided on an upper surface of the bottom plate portion of the support base portion, wherein the support frame portion is configured to support the bottom of the inner container, the support base portion including a seat step portion on which an opening end of the cover fitted to the support member is seated, wherein the cover is made of hard plastic, and the support member is made of soft plastic.

2. The refillable container according to claim 1, wherein the support member includes a seat projecting portion formed on a portion of an outer periphery of the tubular leg portion of the support base portion exposed from the cover fitted to the support member.

3. The refillable container according to claim 2, wherein the seat projecting portion formed on the outer periphery of the tubular leg portion of the support base portion is formed at each of positions opposed to each other across substantially a center of the tubular leg portion.

4. The refillable container according to claim 1, wherein the cover includes a cutout portion formed in a portion of an opening end of a tubular wall portion of the cover.

* * * * *